US005103626A

United States Patent [19]

Morrison

[11] Patent Number: 5,103,626

[45] Date of Patent: Apr. 14, 1992

[54] FASCIATED YARN STRUCTURE MADE BY VACUUM SPINNING

[75] Inventor: Elbert F. Morrison, Clarksville, Va.

[73] Assignee: Burlington Industries, Inc., Greensboro, N.C.

[21] Appl. No.: 844,161

[22] Filed: Mar. 26, 1986

Related U.S. Application Data

[63] Continuation-in-part of Ser. No. 677,487, Dec. 3, 1984, Pat. No. 4,713,931, Ser. No. 680,510, Dec. 11, 1984, Pat. No. 4,719,744, and Ser. No. 732,256, May 9, 1985, Pat. No. 4,635,435, which is a continuation-in-part of Ser. No. 677,487, , which is a continuation-in-part of Ser. No. 386,078, Jun. 7, 1982, Pat. No. 4,507,913, said Ser. No. 680,510, is a continuation-in-part of Ser. No. 386,078.

[51] Int. Cl.[5] ..... D02G 3/02

[52] U.S. Cl. ..... 57/224; 57/328

[58] Field of Search ..... 57/200, 204–209, 57/224, 328, 210

[56] References Cited

U.S. PATENT DOCUMENTS

| | | | |
|---|---|---|---|
| 3,365,872 | 1/1968 | Field, Jr. | 57/224 |
| 3,623,195 | 11/1971 | Nechvatal et al. | 28/276 X |
| 3,831,369 | 8/1974 | Northup et al. | 57/210 |
| 3,978,648 | 9/1976 | Yamagata et al. | 57/224 |
| 4,028,874 | 6/1977 | Maag et al. | 57/210 |
| 4,183,202 | 1/1980 | Morihashi | 57/328 |
| 4,265,082 | 5/1981 | Sasaki et al. | 57/328 X |
| 4,287,714 | 9/1981 | Takai | 57/210 X |
| 4,322,944 | 4/1982 | Sraitr et al. | 57/328 |
| 4,356,690 | 11/1982 | Minorikawa et al. | 57/210 |
| 4,468,921 | 9/1984 | Shibata et al. | 57/333 |
| 4,492,075 | 1/1985 | Faure | 57/224 X |
| 4,495,757 | 1/1985 | Dimitrov | 57/224 X |
| 4,497,167 | 2/1985 | Nakahara et al. | 57/328 |
| 4,505,100 | 3/1985 | Yoshiyuki et al. | 57/207 |
| 4,507,913 | 4/1985 | Morrison | 57/328 |
| 4,509,322 | 4/1985 | Briner et al. | 57/328 X |
| 4,598,537 | 7/1986 | Kroupa et al. | 57/328 X |

FOREIGN PATENT DOCUMENTS

| | | |
|---|---|---|
| 499131 | 9/1976 | Australia . |
| 525499 | 1/1980 | Australia . |
| 538957 | 10/1981 | Australia . |
| 553335 | 10/1984 | Australia . |
| 143050 | 10/1971 | Czechoslovakia . |
| 3002952 | 8/1980 | Fed. Rep. of Germany . |

OTHER PUBLICATIONS

Patent Abstacts of Japan, vol. 9, No. 52 (C-269) [1775], Mar. 6, 1985; & JP-A-59 192 730 (Toyoda Jido Shokki Seisakusho) Jan. 11, 1984.

Patent Abstracts of Japan, vol., No. 36 (C-266) [1759], Feb. 15, 1985; & JP-A-59 179 829 (Toyoda Jido Shokki Seisakusho) Dec. 10, 1984.

Lunenschloss et al., "Mechanisms of OE-Friction Spinning", pp. 29, 32, 36, 38, 42, 45, 48, 52, 56, 57, 59; Lecture at Jul. 10, 1985 Gordon Research Conference in New London, U.S.A.

*Primary Examiner*—Daniel P. Stodola

*Attorney, Agent, or Firm*—Nixon & Vanderhye

[57] ABSTRACT

A fasciated yarn is produced that is suitable for making apparel fabric from predominantly non-thermoplastic staple fibers, and which approaches ring spun yarn in properties and appearance but can be produced much more quickly and simply. The fasciated yarn comprises vacuum spun yarn consisting of fibers including core fibers and wrapper fibers, the wrapper fibers being predominantly individual fibers although having some groups of wrapper fibers. The groups of wrapper fibers appear as non-uniform, non-consistent groupings and provide a relatively smooth appearance. The wrapper fibers are wrapped at a helix angle of about 30° (e.g. about 30°-50°), and about 20-30 percent of the fiber mass comprises the wrapper fibers. The wrappers are essentially devoid of auger or corkscrew appearance. The core fibers are essentially parallel staple fibers. The wrapped and core fibers have the same dyeability. Vacuum spun yarn has a break strength comparable to a break strength of at least 500 grams break strength for a yarn produced from approximately 1/18's count fibers of 55 percent polyester and 45 percent wool, or at least 175 grams for 100 percent wool.

18 Claims, 5 Drawing Sheets

FIG. 3 CORE SPUN (PRIOR ART)
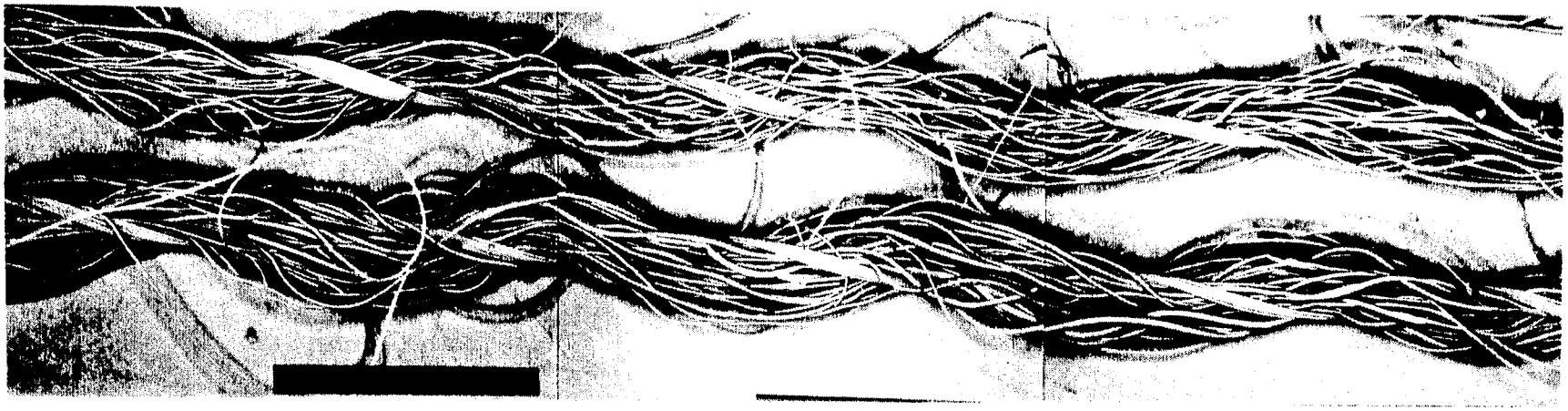
FIG. 1
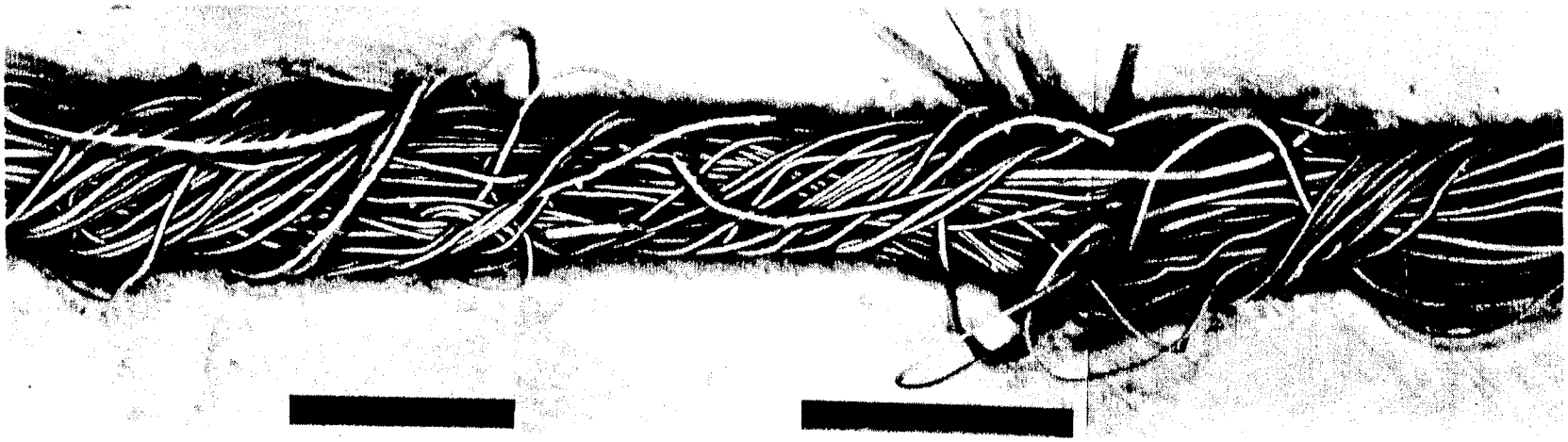

FIG. 4 OPEN-END (PRIOR ART)
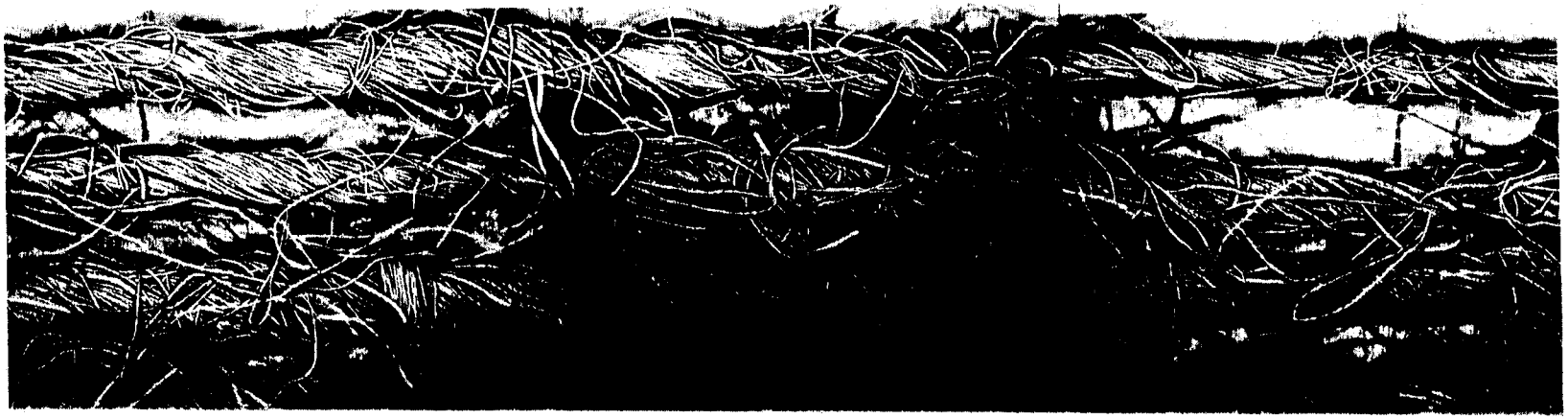
FIG. 2
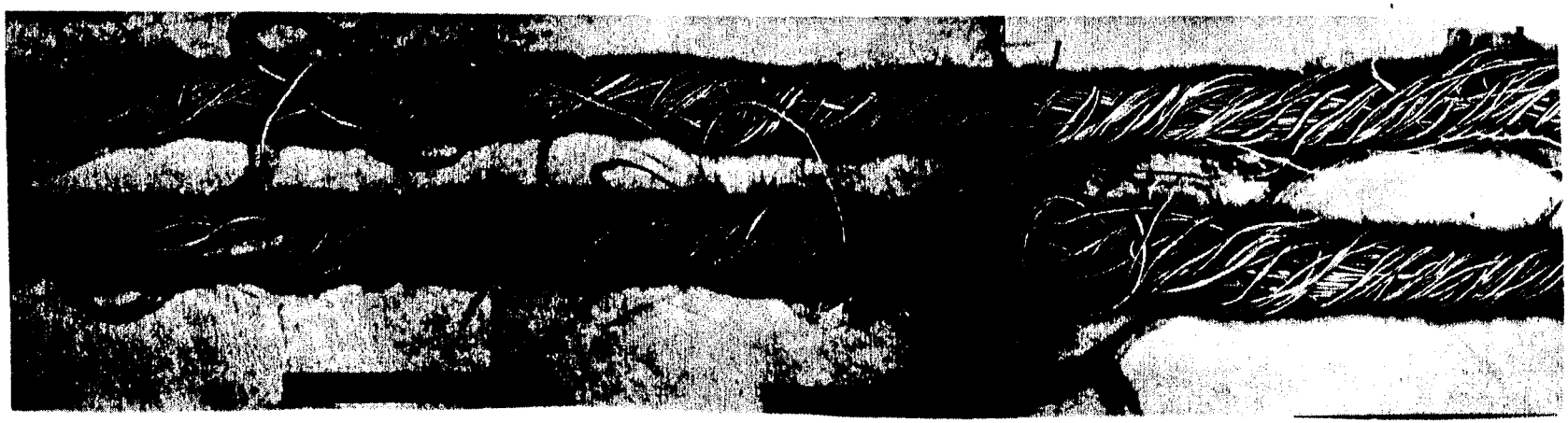

FIG. 5 RING SPUN (PRIOR ART)
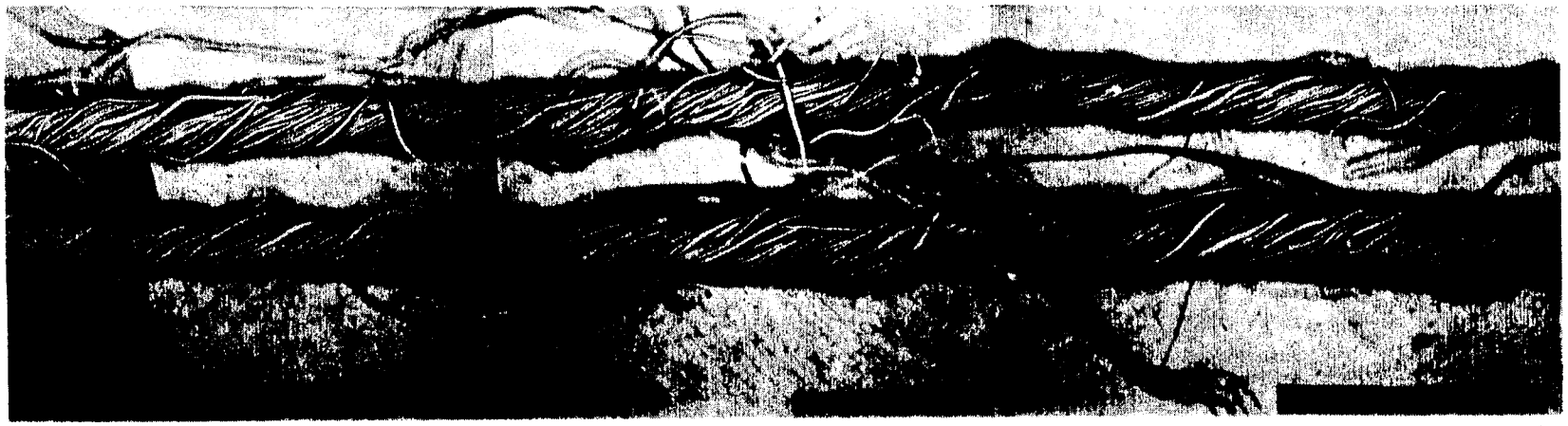
FIG. 6 MJS (PRIOR ART)
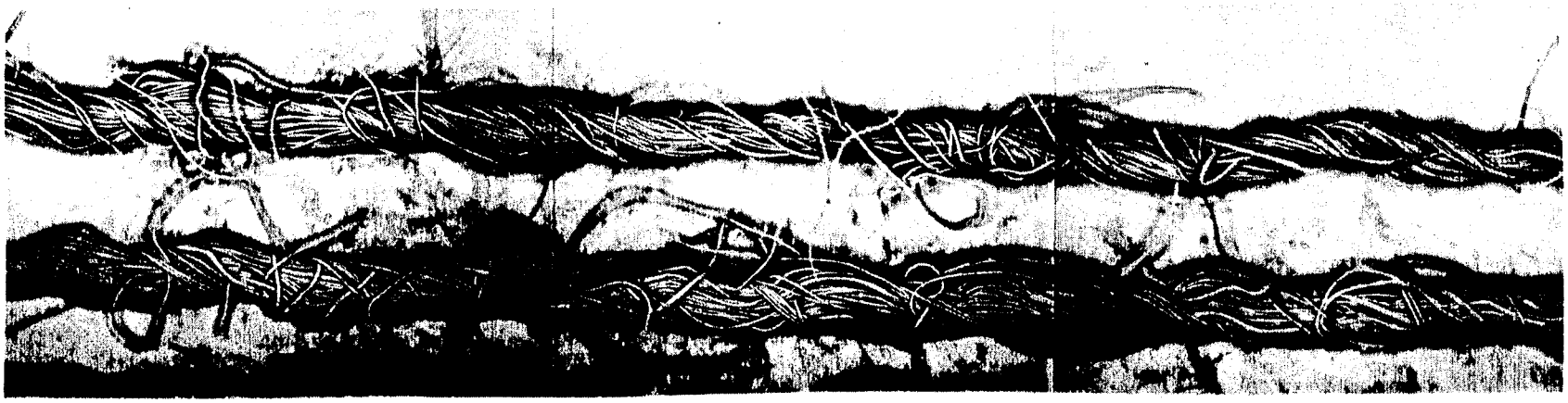

FIG. 7 TORAY (PRIOR ART)
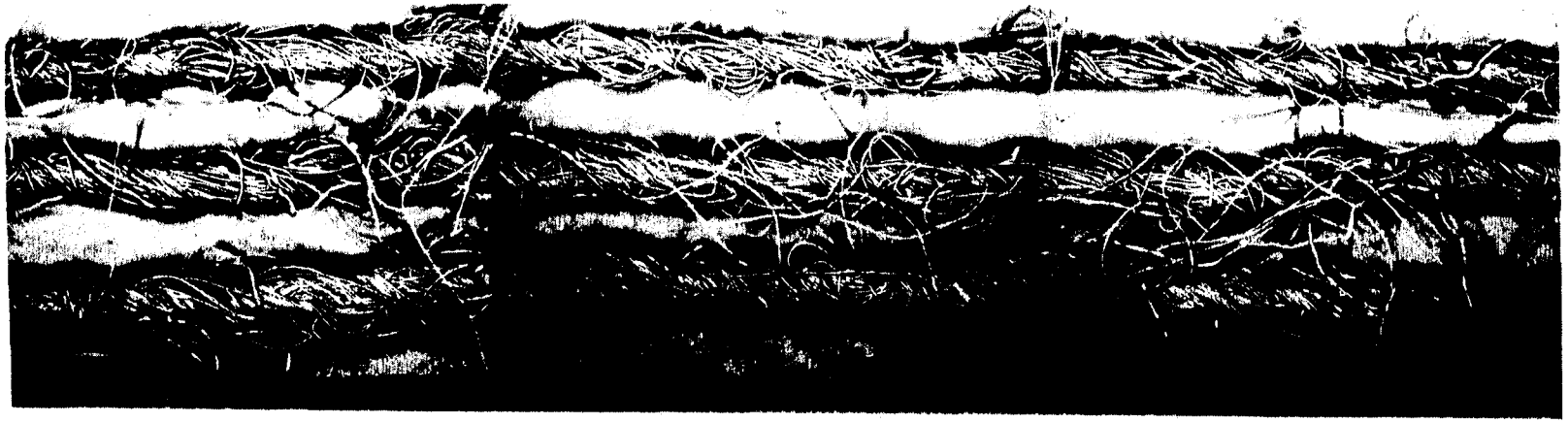
FIG. 8 DREF II (PRIOR ART)
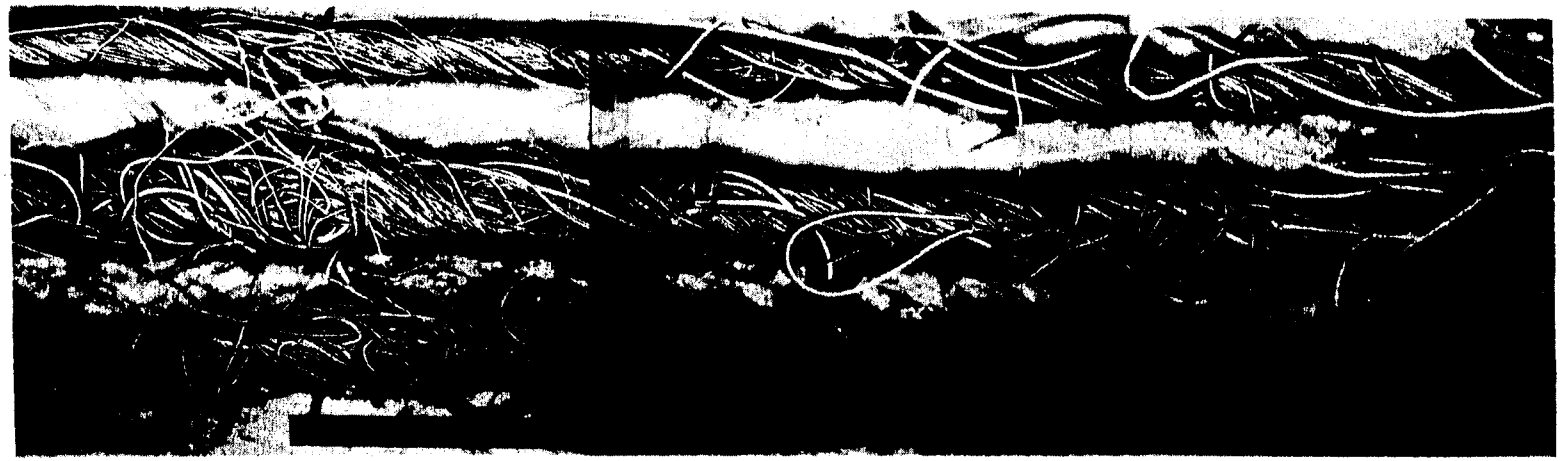

FASCIATED YARN STRUCTURE MADE BY VACUUM SPINNING

This application is a continuation-in-part of each of applications Ser. Nos. 677,487, filed Dec. 3, 1984, now U.S. Pat. No. 4,713,931, dated Dec. 22, 1987, which, in turn, is a continuation-in-part of application Ser. No. 386,078, filed Jun. 7, 1982, now U.S. Pat. No. 4,507,913, dated Apr. 2, 1985; application Ser. No. 680,510, filed Dec. 11, 1984, now U.S. Pat. No. 4,719,744, dated Jan. 19, 1988, which, in turn, is a continuation-in-part of the same application Ser. No. 386,078, filed Jun. 7, 1982; and now U.S. Pat. No. 4,507,913; and application Ser. No. 732,256, field May 9, 1985, now U.S. Pat. No. 4,635,435, issued Jan. 13, 1987, which in turn is a continuation-in-part of said application Ser. No. 677,487, filed Dec. 3, 1984 and now U.S. Pat. No. 4,713,931.

BACKGROUND AND SUMMARY OF THE INVENTION

In a number of co-pending applications, an apparatus and method have been provided which seek to produce yarns having properties approaching those of ring spun yarn, only at significantly greater speeds and with other significant operational advantages including automatic elimination of lint fly or oily waste, and reduction in the number of process steps compared to ring spun yarn. Such methods and apparatus are shown in co-pending application Ser. No. 677,487 filed Dec. 3, 1984, 680,510 filed Dec. 11, 1984, 732,256 filed May 9, 1985, and 732,319 filed May 9, 1985.

The methods employed in the above-identified applications and in U.S. Pat. No. 4,507,913, issued Apr. 2, 1985, have come to be known by the name "vacuum spinning". It has been recognized that the yarn produced by advanced vacuum spinning techniques has a unique construction and appearance. The construction of the yarn can be described in a number of different manners including both independent and relative (to other spun yarn produced by other techniques) manners.

The yarn according to the present invention includes core fibers and wrapper fibers. The wrapper fibers are predominantly individual fibers, although there are some groups of wrapper fibers. The groups of wrapper fibers appear as non-uniform, non-consistent fiber groupings, and provide a relatively smooth surface. The core fibers, on the other hand, are essentially parallel with the wrapper fibers uniformly distributed therearound. The fasciated yarn according to the invention thus looks most like ring spun yarn of the commonly known yarns, although it is distinct in appearance from ring spun yarn too. For instance the yarn according to the invention looks more like ring spun yarn than core spun, open-end MJS, Toray, or DREF II prior art yarns. MJS means Munata Jet Spun Yarn.

The fasciated yarn according to the invention has, as set forth above, essentially parallel core staple fibers. There is a uniform distribution of staple fiber wrapper fibers around the core fibers, the wrapper fibers being wrapped at a helix angle of about 30°, and with about 20–30 percent of the fiber mass comprising wrapper fibers.

The fasciated yarn according to the invention can also be described as a yarn having a core of essentially parallel staple fibers with the wrapped staple fibers disposed around the core forming a helix angle in the range of about 30°–50°, and the wrapped fibers are devoid of tucked or reverse wrapped fibers and are essentially devoid of auger or corkscrew appearing wrapped fibers. Rather the wrapped fibers have a smooth appearance.

The fasciated yarn according to the invention can be produced with the predominant proportion of staple fibers of the core and covering as non-thermoplastic staple fibers. While the predominant proportion of the core and wrapped fibers can be selected from the group consisting of cotton, wool, rayon, mohair, flax, ramie, silk, and blends thereof, the yarn according to the invention also can be constructed using some, or all, thermoplastic fiber, such as acrylic, polyester, and other thermoplastic fibers or blends thereof.

The yarn produced according to the present invention has surprising and desirable strength. For instance yarn produced according to the invention from a 1/18's count of 45 percent polyester and 55 percent wool will have a minimum gram break strength of about 500, while yarn according to the present invention with the same count made from 100 percent wool will have a minimum gram break strength of at least about 175. Thus even when made from 100 percent wool the yarn according to the present invention is suitable for making apparel fabrics.

It is the primary object of the present invention to provide a unique and desirable fasciated yarn having an appearance and properties comparable to those of ring spun yarn, but producible at increased speeds. This and other objects of the invention will become clear from an inspection of the detailed description of the invention, and from the appended claims.

BRIEF DESCRIPTION OF THE DRAWINGS

FIG. 1 is a microphotograph at approximately 70× magnification of vacuum spun yarn according to the present invention;

FIG. 2 is a microphotograph of the same yarn as FIG. 1 only at a magnification of 35×;

FIGS. 3 through 8 are microphotographs of other, conventional, spun yarns made respectively by core spinning, open-end, ring spun. MJS, Toray, and DREF II techniques respectively.

DETAILED DESCRIPTION OF THE DRAWINGS

Figure 9:
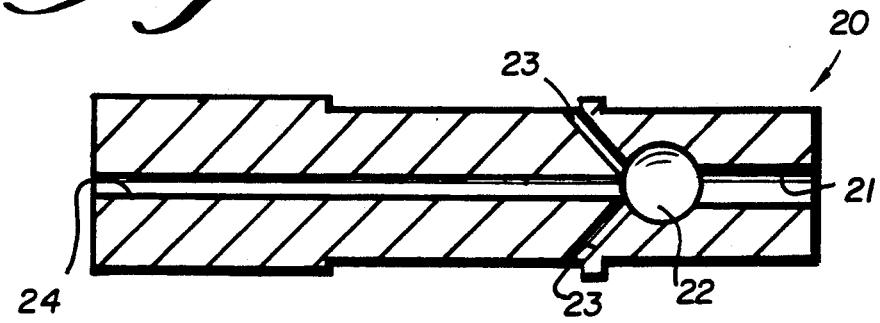
FIGS. 9 through 11 are cross-sectional schematic views of exemplary vacuum spinning "nozzles" that may be utilized for the production of the vacuum spun yarn of FIGS. 1 and 2.
Figure 10:
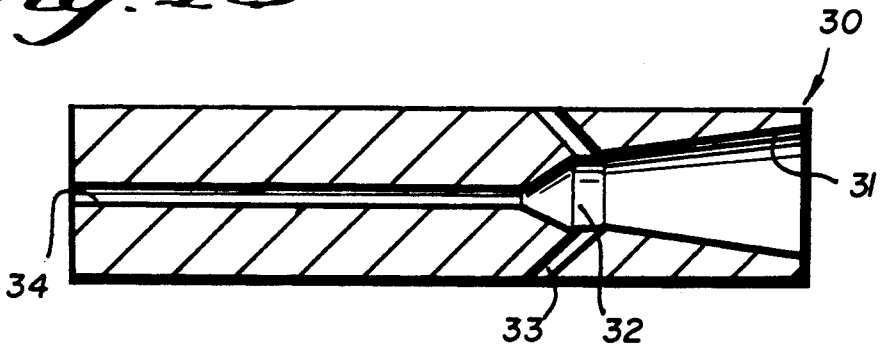
Figure 11:
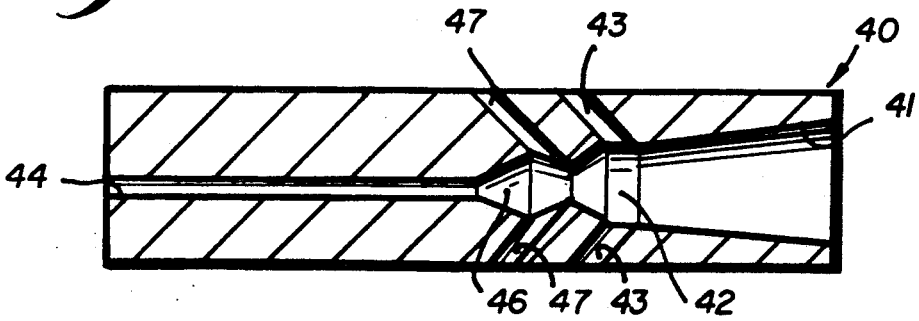

The nozzles of FIGS. 9 through 11 are utilized in apparatus as set forth in the above-identified co-pending applications, or in issued Pat. No. 4,507,913, for the production of vacuum spun yarn. In tests run utilizing the nozzles of FIGS. 9 through 11, respectively, with different blends and worsted counts of yarn, the following results were obtained (all results plus or minus E, i.e., the range of values, the average of which is actually set forth; and "SS" means "short staple"):

TABLE I

| | Yarn of FIG. 1 | Another Vacuum Spun Yarn | Another Vacuum Spun Yarn | Vacuum Spun With SS Drafting Arrangement |
|---|---|---|---|---|
| Worsted Count | 1/18.30 ± 0.48 | 1/18.23 ± 0.18 | 1/18.11 ± 0.16 | 1/17.52 ± 0.12 |
| Single Twist | Air Spun | Air Spun | Air Spun | Air Spun |
| Evenness % CV | 15.44% | 14.73% | 15.09% | 16.59% |
| Thin Places/1000 Yds. | 36.0 | 4.0 | 6.0 | 34.0 |
| Thick Places/1000 Yds. | 19.0 | 0.0 | 4.0 | 89.0 |
| Neps/1000 Yds. | 5.0 | 4.0 | 4.0 | 62.0 |
| % Elongation | 15.40% ± 0.55 | 18.1% ± 0.54 | 12.2% ± 0.52 | 9.7% ± 0.48 |
| % CV of Elongation | 12.5% | 10.5% | 13.0% | 17.2% |
| % Under 10% | 0.0% | 0.0% | 21.0% | 40.0% |
| Gram Break | 504.0 ± 12.10 | 593.5 ± 18.60 | 279.4 ± 16.760 | 653.3 ± 14.80 |
| % CV of Break | 8.4% | 11.0% | 9.6% | 8.0% |
| % Under 125 Grams | 0 | 0 | 0 | 0 |
| Blend | | | | |
| % Poly. | 45.74% | 57.37% | 0 | 59.07% |
| % Wool | 54.26% | 42.63% | 100% | 0 |
| % Cotton | 0 | 0 | 0 | 40.93% |
| Shrinkage | | | | |
| Boil-Off | 2.75% ± 0.31 | 6.22% ± 0.31 | 3.0% ± 0.30 | 3.54% ± 0.32 |
| Dry-Heat | 2.31% ± 0.82 | 6.29% ± 0.93 | 1.5% ± 0.20 | 3.76% ± 0.30 |
| Oil Content | 0.56% | 0.61% | 0.58 | 0.12% |
| Kink Level/18" | 14.7 | 18.7 | 20.0 | 19.3 |
| Average Staple Length | 3.5" | 3.5" | 3.5" | 1.5" |
| Nozzle Used | FIG. 9 | FIG. 11 | FIG. 10 | FIG. 9 |
| Spun From | Sliver | Roving | Roving | Roving |
| Size of Input Sliver of Roving | 55 Grs./Yd. | 2 ends 2.5 HR | 2 ends 2.5 HR | 2 ends 1.5 HR |

As can be seen from the test results, the yarn produced according to the present invention has a break strength comparable to a break strength of at least 500 gram Breakstrength for a yarn produced from 1/18's count fibers of 55 percent polyester and 45 percent wool. Tests were also conducted utilizing a nozzle like that of FIG. 10 only having the actual chamber construction like that of chamber 46 of FIG. 11. In such tests, when yarn with a blend of 45 percent polyester and 55 percent wool was spun from sliver with a count of 1/18's the gram break strength was 518 and the elongation 8.4 percent. When spun from 100 percent wool sliver with the same count the gram break strength was 248 and the elongation 14.1 percent. Thus by practicing the invention, too, it is possible to produce yarn having sufficient strength to be used as an apparel fabric from non-thermoplastic staple fibers.

Note that the nozzle 20 of FIG. 9 has a passageway portion 24 communicating with a second end thereof, and a passageway portion 21 communicating with a first end thereof. Between the passageway portions 21, 24 a ¼ inch diameter spherical vacuum reservoir 22 is provided with four 1/16 inch diameter angled perforations 23 extending outwardly from the reservoir 22.

In FIG. 10, The nozzle 30 has a first passageway section 31 that has the shape of a cone frustum, and a second passageway section 34 that is comparable to the passageway 24 of the FIG. 9 embodiment. It also has an intermediate passageway portion 32 that may be considered a vacuum reservoir, which has a conical shape, with four 1/16 inch angled perforations 33 in communication therewith.

The nozzle 40 of FIG. 11 includes the first, conical, passageway portion 41, a second portion 44 comparable to the passageway portion 24 of the FIG. 9 embodiment, and a pair of passageway portions 42, 46 each which are generally conical in shape and have four 1/16 inch angled perforations 43, 47, respectively extending outwardly therefrom.

Viewing the vacuum spun yarn according to the present invention illustrated in FIGS. 1 and 2, it will be seen that a fasciated yarn is provided consisting of staple fibers including core fibers and wrapper fibers. The wrapper fibers are predominantly individual fibers although there are some groups of wrapper fibers. The groups of wrapper fibers appear as non-uniform, non-consistent fiber groupings and provide a relatively smooth surface. The core fibers are essentially parallel with the wrapper fibers uniformly distributed therearound. The core fibers have the same dyeability as the wrapper fibers.

Another way that the yarn of FIGS. 1 and 2 can be described is a fasciated yarn having essentially parallel core staple fibers and having a uniform distribution of staple wrapper fibers around the core fibers. The wrapper fibers each have one end embedded in the core and the remainder wrapped at a helix angle of about 30° (e.g. within the range of about 30°-50°) and about 20-30 percent of the fiber mass comprises wrapper fibers. The wrapped fibers are devoid of tucked or reverse wrapped fibers and are essentially devoid of auger or corkscrew appearing wrapped fibers, rather having a smooth appearance.

Comparing the vacuum spun yarn of FIGS. 1 and 2 to the conventional ring spun yarn of FIG. 5, and to the other conventional spun yarns of FIGS. 3 and 5 through 8, it will be seen that the vacuum spun yarn of FIGS. 1 and 2 has an appearance closest to that of the ring spun yarn of FIG. 5.

Note that the core spun yarn of FIG. 3 has core fibers which are parallel with a filament yarn twisted (a true twist) around the mass of yarn for strength. This is not a fasciated yarn.

The open end yarn of FIG. 4 also has true twist, with a surface dotted with wrapper fibers loose around the mass. Again this is not a fasciated yarn.

The MJS air spun yarn of FIG. 6 is the next closest to ring spun yarn (that is next closest with vacuum spun yarn being the closest) of the known spun yarns. The MJS yarn has fibers wrapped at approximately a 55° angle showing a small amount of twist in the core fibers. The percentage of wrapped fibers is approximately 10 percent. The wrapper fibers are more or less in the form of individual fibers.

The Toray yarn of FIG. 7 has wrapper fibers which are disposed at approximately a 45° angle and appear to be buried deeper into the core fibers than for the other yarns, causing a corkscrew appearance. The surface fibers tend to be tangled in the fiber mass similar to Taslan yarns. Approximately 20 percent of the fibers are wrapped surface fibers. The auger or corkscrew look of the Toray yarn is vastly different than the smooth appearance of vacuum spun yarn.

The DREF II yarn of FIG. 8 is friction spun yarn with true twist and without any surface wrapped fibers. This yarn is also not a fasciated yarn.

It is noted that the fasciated yarn according to the invention can be made from 100 percent non-thermoplastic staple fibers, or the predominant portion of the staple fibers of the core and covering can be non-thermoplastic staple fibers. That is at least the predominant portion of the staple fibers forming the fasciated yarn according to the invention can be selected from the group consisting of cotton, mohair flax, Ramie, silk, wool, rayon, and blends thereof. However the fasciated yarn according to the invention is not restricted to non-thermoplastic fibers, but also can be produced from, or from blends of (with non-thermoplastic fibers) acrylic, polyester, and other fibers.

Note that vacuum spun yarn has many differences compared to other known fasciated yarns. Some properties of vacuum spun yarns that are not true of all other fasciated yarns are as follows: vacuum spun yarn does not require thermoplastic fibers, has controlled wrapping of surface fibers, the wrapped fibers can be the same as the core (not fused by heat), the yarns will dye the same since the molecular structure thereof is not changed (the core and surface fibers have the same dyeability), and the wrapped fibers are laid parallel and not looped over each other in a non-uniform pattern.

It will thus be seen that according to the present invention a yarn suitable for making apparel fabric, comprising a fasciated yarn, is provided which has good strength and appearance properties, and most closely simulates ring spun yarn. Yet the yarn according to the present invention can be produced at much higher speeds than ring spun yarn and with fewer steps. For instance in ring spinning long staple yarns, first the staple fibers are blended, gilled, combed, gilled four times, used to produce a roving, spun, wound, and then put to an end use. Vacuum spun yarn according to the invention. on the other hand, made from long staple fibers is produced as follows: the fibers are blended, gilled combed, gilled three times, vacuum spun, and put to the end use. Thus three less steps are used in vacuum spinning long staple fibers compared to ring spinning long staple fibers. In vacuum spinning short staple fibers, the same number of steps are used as for air jet spinning short staple fibers, namely blending, carding, drawing twice, spinning, and putting to an end use.

While the invention has been herein shown and described in what is presently conceived to be the most practical and preferred embodiment thereof, it will be apparent to those of ordinary skill in the art that many modifications may be made thereof, within the scope of the appended claims, which scope is to be accorded the broadest interpretation possible in order to encompass all equivalent yarn end and products.

What is claimed is:

1. A yarn for use in making apparel fabric comprising:

a central core of staple fibers substantially parallel to one another; and a covering of staple fibers which have one end embedded in the core and the remainder wrapped around the core such that the wrapping portions of the covering fibers form a helix angle within the range of about 30°–50°; and wherein the predominant proportion of staple fibers of the core and covering are non-thermoplastic staple fibers.

2. A yarn as recited in claim 1 wherein the predominant proportion of core and wrapped fibers of the yarn are selected from the group consisting of cotton, wool, rayon, mohair, flax, ramie silk, and blends thereof.

3. A yarn as recited in claim 1 having a break strength comparable to a break strength of at least about 500 gram break strength for a yarn produced from approximately 1/18's count fibers of 55 percent polyester and 45 percent wool.

4. A fasciated yarn as recited in claim 1 produced from 100 percent non-thermoplastic fiber, and having a break strength comparable to a break strength of at least about 175 gram break strength for a yarn produced from approximately 1/18's count fibers of 100 percent wool.

5. A fasciated yarn as recited in claim 1 wherein said covering of staple fibers wraps around the core in only one direction.

6. A fasciated yarn having essentially parallel core staple fibers, and uniform distribution of staple wrapper fibers around the core fibers, the wrapper fibers being wrapped at a helix angle of about 30°, and with about 20–30 percent of the fiber mass comprising wrapper fibers, the fasciated yarn having an appearance closely approximating that of ring spun yarn.

7. A yarn as recited in claim 6 wherein the predominant proportion of core and wrapped fibers of the yarn are selected from the group consisting of cotton, wool, rayon, mohair, flax, ramie silk, and blends thereof.

8. A fasciated yarn as recited in claim 6 including thermoplastic fibers.

9. A fasciated yarn as recited in claim 6 having a break strength comparable to a break strength of at least about 500 gram break strength for a yarn produced from approximately 1/18's count fibers of 55 percent polyester and 45 percent wool.

10. A fasciated yarn as recited in claim 6 produced from 100 percent non-thermoplastic fiber, and having a break strength comparable to a break strength of at least about 175 gram break strength for a yarn produced from approximately 1/18's count fibers of 100 percent wool.

11. A fasciated yarn as recited in claim 6 wherein the wrapper fibers wrap around the core in only one direction.

12. A fasciated yarn having a core of essentially parallel staple fibers, and wrapped staple fibers disposed around the core, the wrapped staple fibers forming a helix angle in the range of about 30°–50°; the wrapped fibers being devoid of tucked or reverse wrapped fibers, and being essentially devoid of auger or corkscrew appearing wrapped fibers, rather having a smooth appearance of wrapped fibers.

13. A yarn as recited in claim 12 wherein the predominant proportion of staple fibers of the core and wrapping fibers are non-thermoplastic staple fibers.

14. A yarn as recited in claim 13 wherein the predominant proportion of core and wrapped fibers of the yarn are selected from the group consisting of cotton, wool, rayon, mohair, flax, ramie, silk, and blends thereof.

15. A fasciated yarn as recited in claim 12 including thermoplastic fibers.

16. A fasciated yarn as recited in claim 12 having a break strength comparable to a break strength of at least about 500 gram break strength for a yarn produced from approximately 1/18's count fibers of 55 percent polyester and 45 percent wool.

17. A fasciated yarn as recited in claim 12 produced from 100 percent non-thermoplastic fiber, and having a break strength comparable to a break strength of at least about 175 gram break strength for a yarn produced from approximately 1/18's count fibers of 100 percent wool.

18. A fasciated yarn as recited in claim 12 wherein the wrapper fibers wrap around the core in only one direction.

* * * * *